United States Patent [19]

Daunt

[11] Patent Number: 4,927,083

[45] Date of Patent: May 22, 1990

[54] ELONGATED SHOWER HEAD

[76] Inventor: N. Charles Daunt, 6 Nautilis Rd., Hilton Head Island, S.C. 29928

[21] Appl. No.: 439,519

[22] Filed: May 9, 1989

[51] Int. Cl.[5] ..... B05B 15/06

[52] U.S. Cl. ..... 239/282; 4/569; 4/570; 239/561; 239/562; 239/567; 239/DIG. 1

[58] Field of Search ..... 239/282, 283, 548, 559, 239/560, 562, 567, DIG. 1, 561; 4/567, 568, 569, 570, 615

[56] References Cited

U.S. PATENT DOCUMENTS

| | | | |
|---|---|---|---|
| 870,766 | 11/1907 | Eaton | 4/601 |
| 924,602 | 6/1909 | Dimond | 4/567 |
| 931,890 | 8/1909 | Rheinfrank | 4/601 |
| 944,611 | 12/1909 | Holmes | 4/567 |
| 2,746,792 | 5/1956 | Hough | 239/DIG. 1 |
| 3,858,252 | 1/1975 | Ejchorszt | 4/601 |
| 3,948,879 | 10/1976 | Ejchorszt | 4/601 |

FOREIGN PATENT DOCUMENTS

| | | | |
|---|---|---|---|
| 642738 | 5/1964 | Belgium | 239/567 |
| 794448 | 2/1936 | France | 239/548 |
| 689010 | 4/1965 | Italy | 239/567 |

*Primary Examiner*—Andres Kashnikow
*Assistant Examiner*—Michael J. Forman
*Attorney, Agent, or Firm*—Willard M. Hanger

[57] ABSTRACT

An improved shower head comprising a length of hollow tubing in the shape of a vertically disposed loop having spaced apart, vertically supported side sections and a horizontally supported bottom section joining respective lower ends of the side sections in which a preferred embodiment of the loop is annular in shape to include a horizontally supported top portion joining respective upper ends of the side sections, the outer wall portions of the tubing forming the outer face of the loop facing the bather containing spaced apart orifices producing a vertically disposed spray pattern. The orifices are located along the tubing wall region of the interior portion of the loop outer face an offset distance from the center line of the outer tubing wall that forms the face of the loop generating a spray pattern having an inwardly directed component around the periphery of the loop or annulus. The improvement relates to a variation in the angular location of the orifices with respect to the tubing wall region interiorally of the loop outer face and central axis of the tubing in different sectors of the bottom section of the annular loop and a variation in the spacing between adjacent orifices along the bottom section establishing a larger upperwardly directed angle of spray and a greater volume of spray in the central portion of the bottom section of the loop, thereby providing superior cleansing action on the lower trunk portion of the bather's body.

22 Claims, 6 Drawing Sheets

ELONGATED SHOWER HEAD

BACKGROUND OF THE INVENTION

This invention relates to an improved, vertically oriented, elongated shower head of hollow tubing containing spaced apart orifices and formed in the shape of a two-sided loop having a pair of vertically oriented side portions connected at the lower ends by a horizontally extending bottom portion. A preferred shape of the loop includes a horizontally extending top portion joining the upper ends of the vertically extending side portions so as to establish the shower head in the form of an elongated annulus that produces an annular needle spray over the length of the bather's trunk body at various intensities and angles as will provide optimum washing action where most needed. Standard overhead showers direct the spray downwardly onto the head, shoulder and chest portions of the bather's body, whereas the lower portion of the body trunk, particularly that in the hip region between the legs, requires the greatest washing action. These regions can be reached by hand held spray heads on flexible lines but this requires the diversion of one or both hands which is not always convenient or is impractical for those whose hands and arms are crippled with arthritis or are missing. Spaced apart, multiple shower heads that are vertically arranged provide some degree of washing action over the length of the bather's body but the spray from each of such heads fans outwardly and does not impinge inwardly on the sides of the bather. Vertically arranged, loop type tubular needle shower heads of annular shape of the nature of U.S. Pat. Nos. 924,602, 931,890, 944,611 and 3,858,252 do provide a moderately even distribution of water over the length of the body trunk of the bather that is an improvement over the spray provided by a normal overhead shower head or multiple vertically arranged shower heads and has the advantage of not wetting the bather's head area. However, in these annular shower heads the spray apertures are evenly spaced apart along the center line of the annular head and provide a substantially evenly distributed spraying action over the forward facing area of the body trunk of the bather.

SUMMARY OF THE INVENTION

In the illustrated and described preferred embodiment of the applicant's invention the loop type shower head comprises an integral length of hollow tubing formed into an elongated annular shape along the length of which the tubular wall contains small orifices located in a spaced apart pattern as provides an annular spray directed inwardly of the annulus of varying directions and intensities around its circumference. The annular spray head comprising top and bottom horizontally disposed sections connected by the pair of spaced apart, vertically disposed side sections can be detachably attached to the wall of the stall shower and in one embodiment has provisions for being connected between a standard overhead shower head installed in the stall shower and its water supply pipe by means of a flexible line leading from the top of the annular shower head by a T valve connection that may be placed between the standard overhead shower head and the shower water supply line. Suction cups on the outer ends of support members extending from the annular shower head toward the wall permit installation of the annular shower head at an optimum vertical level as can best accommodate the height of the bather. Small spray orifices are located in a spaced apart array along the entire periphery of the annular head along its front face that faces in the direction of the bather. Each of the orifices in the bottom, horizontally extending section and at least the lower portions of the side sections of the annular tubing are located on the front face of the shower head to be offset a short distance from the center line of the outer face of the tubing wall toward the central portion of the annulus so as to establish an inwardly directed annular spray pattern along at least the lower portion of the resulting annular spray pattern. A significant feature of the applicant's invention is that the orifices in at least the central portion of the bottom, horizontally extending tubular section of the shower head are offset from and located at a greater distance from the center line of the outer tubing wall than orifices in the portion of the tubing comprising the outermost segments of the annular shower head. The spray pattern established by these orifices of greater offset from the tube outer wall centerline in the central portion of the bottom section of the head provide a larger upwardly directed component of spray in this central region than orifices having less offset from the tube wall centerline.

An additional significant feature of the illustrated preferred embodiment of the invention is establishing the spacing between adjacent orifices in the horizontally extending, bottom section of the head at a lesser distance than orifices in the tubing adjacent or in the side portions of the annular head, preferably the orifices in the center portion of the bottom section of the head being more closely spaced than those in the outer portions of the bottom section adjacent the vertically extending side portions. A further improvement in the illustrated preferred embodiment involves progressively increasing the spacing between adjacent orifices from the center of the bottom horizontally extending portion of the annular head outwardly toward both vertically extending side sections.

The noted significant features of locating the orifices in a manner to be offset from the centerline of the outer face of the annular tube wall at varying distances and establishing the spacing between adjacent orifices in the noted pattern and arrangement creates a greater concentration of spray onto the lower trunk body of the bather where it is most needed and provides a superior washing action.

An object of the invention is to provide a shower head which creates a maximum concentration of spray onto the lower portion of the bather's body trunk while establishing an adequate spray pattern over the other portions of the bather's body.

Another object of the invention is to provide a shower head that establishes a heavy spraying action on hard to reach body portions without the need to manipulate the hands of the bather.

A further object of the invention is to provide a shower head that generates a generally horizontally and inwardly directed annular spraying pattern that is adjustable to accommodate persons of varying heights.

Still a further object of the invention is to provide a highly versatile shower head generating an inwardly and generally horizontally directed spray pattern that is readily attachable and detachable from the stall shower and can be utilized in conjunction with a standard overhead spray head.

DESCRIPTION OF A PREFERRED EMBODIMENT

Figure 3:
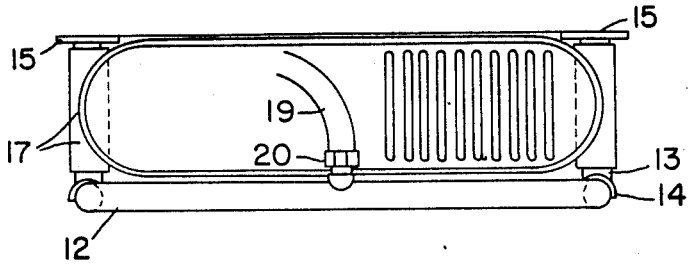
FIG. 3 is a plan view from above of the shower head of FIG. 2.
Figure 1:
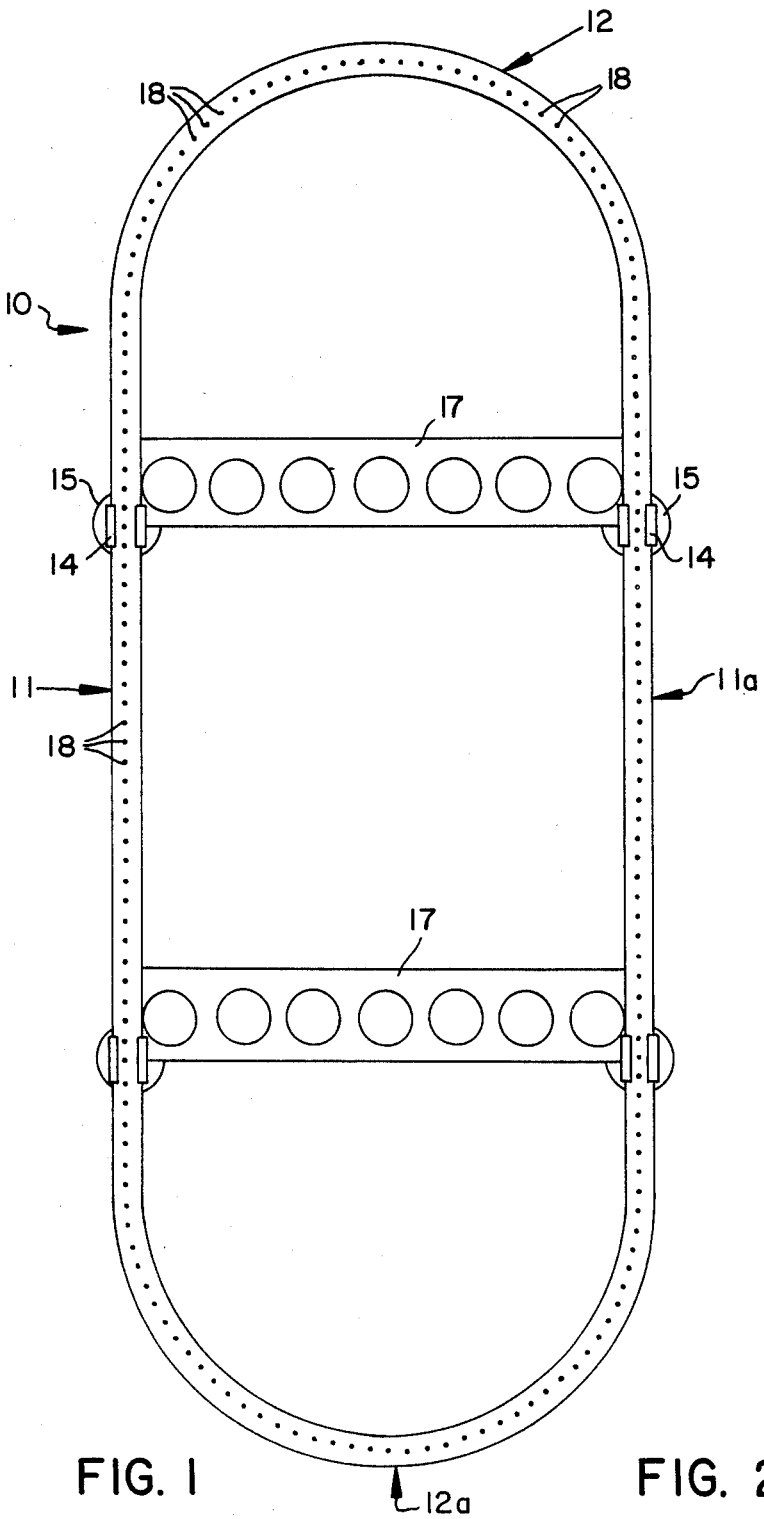
FIG. 1 is a front elevation view of the annular shower head of FIG. 2 omitting the water supply connection.
Figure 2:
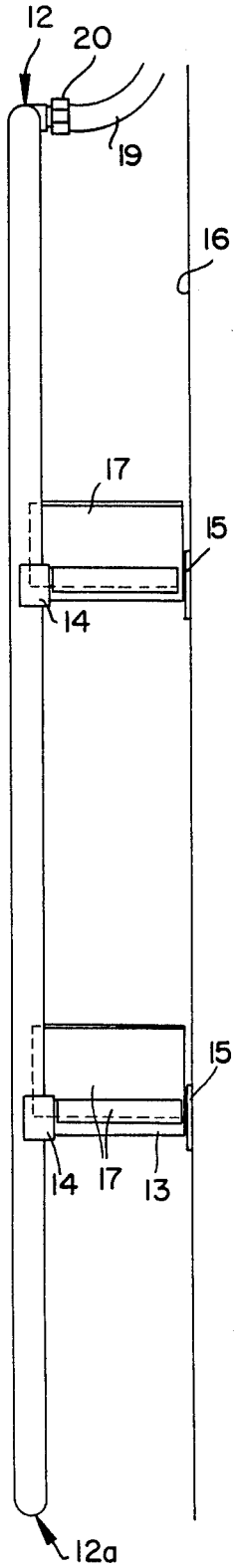
FIG. 2 is a side elevation view of the shower head of FIG. 1 mounted on a stall shower wall.

FIGS. 1–3 illustrate the general arrangement of a preferred embodiment of the shower head in which the loop of hollow tubing is in the form of a continuous loop 10 of elongated annular shape comprising spaced apart, vertically extending, elongated side sections 11, 11*a* joined at their respective upper and lower ends respectively by a horizontally extending top section 12 and a horizontally extending bottom section 12*a*. The length of tubing contains orifices 18 on the outer wall face of the tubing loop facing the bather, the orifices being arranged and spaced apart in a variable pattern as will be subsequently described. A pair of support arms 13 with end clamps 14 clamped to the upper and lower portions of each of the two tubular side sections 11, 11*a* extend outwardly from the rear plane of the annular head 10 with a suction cup 15 at each of the outer ends of the support arms 13 by means of which the shower head 10 may be held in place in a vertical position spaced from and attached to the wall 16 of the stall shower. The height of the shower head 10 may be easily adjusted by moving the positions of the suction cups 15. Stabilizing bars 17 extends transversely of the head 10 between its side sections 11, 11*a* and include a flat, corregated surface which serves as a rack for soap, shampoo and other shower accessories. Alternatively, the shower head assembly could be supported in a vertical position from above or below by various means that would be obvious to one skilled in the art.

Figure 4:
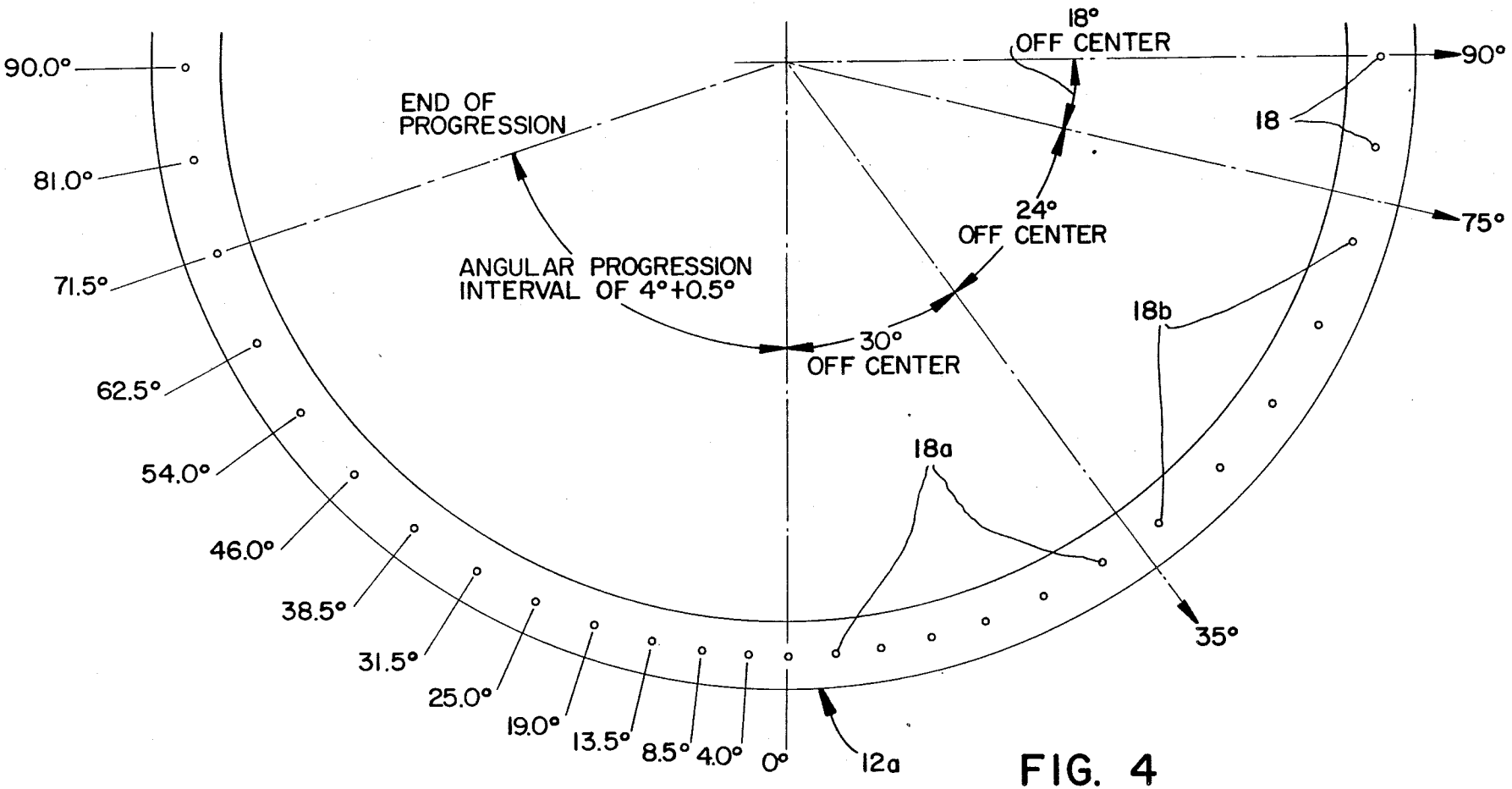
FIG. 4 is a front elevation view of the bottom, horizontally extending tubular section of the annular shower head of FIG. 1 indicating details of the variable arrangement and placement of the orifices.
Figure 5A:
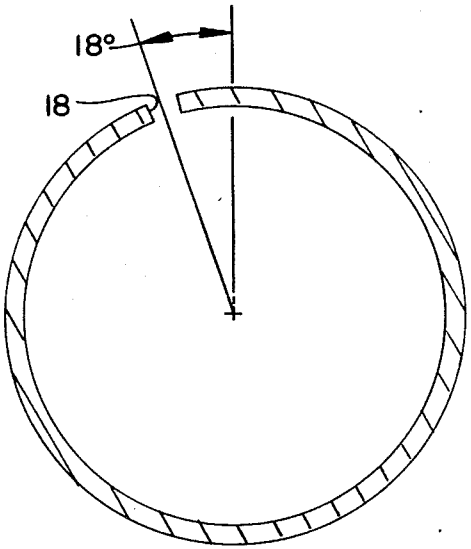
FIG. 5A is a cross sectional view of the segment of FIG. 5.
Figure 5:
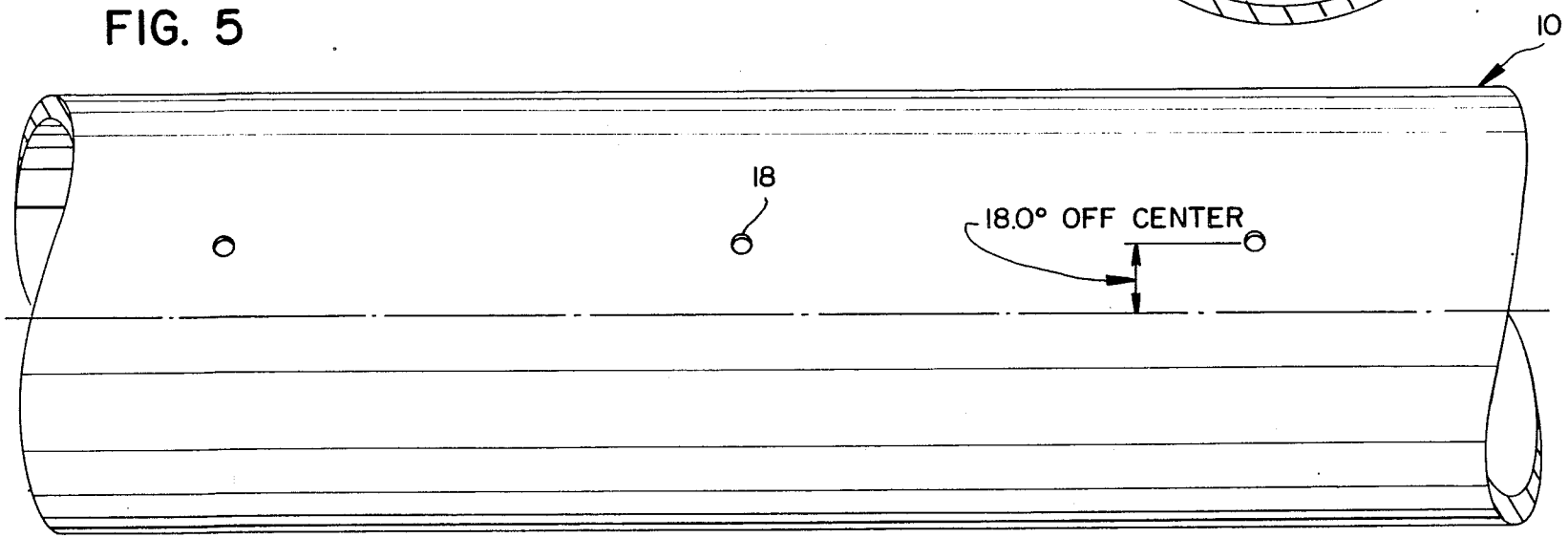
FIG. 5 is an enlarged front elevation view of a major segment of the tubing of the shower head.
Figure 7A:
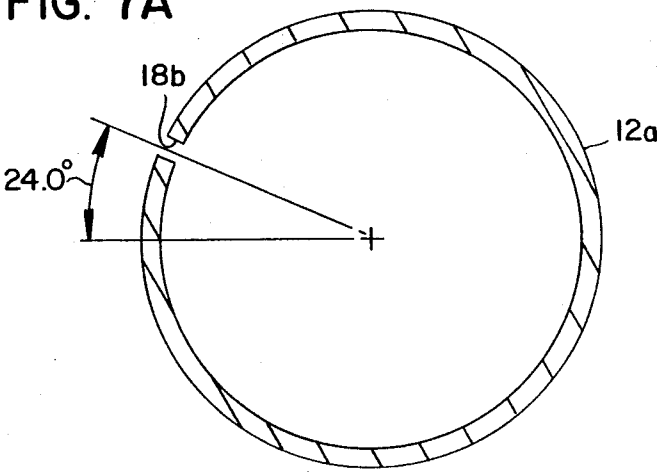
FIG. 7A is a cross sectional view of the segment of FIG. 7.
Figure 7:
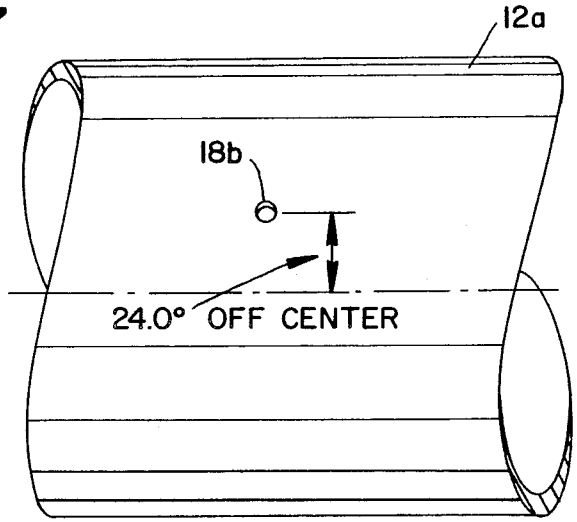
FIG. 7 is an enlarged front elevation view of another segment of the tubing of the bottom section of the shower head of FIG. 4 next to adjacent the segment of FIG. 6.
Figure 6A:
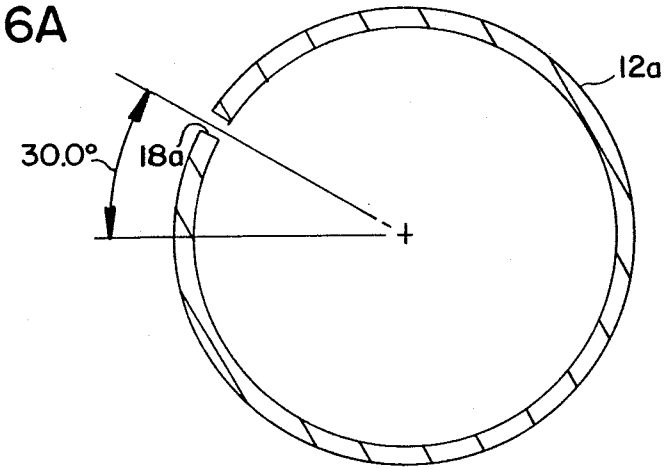
FIG. 6A is a cross sectional view of the segment of FIG. 6.
Figure 6:
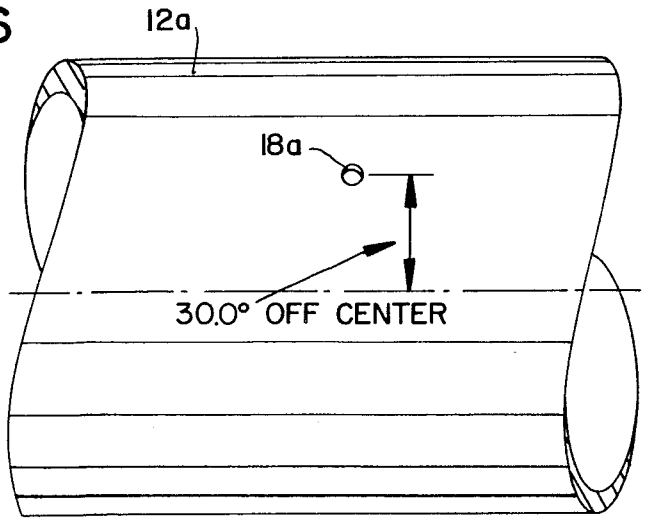
FIG. 6 is an enlarged front elevation view of a segment of the tubing of the bottom central section of the shower head of FIG. 4.

Although FIG. 1 indicates the general pattern and arrangement of the orifices 18 in the wall of the outer face of the tubing forming the annular head 10, reference must be had to FIG. 4, in particular, and to FIGS. 5, 5A, 6, 6A, 7 and 7A for an accurate indication and understanding of the location and pattern of location of the orifices 18 in the various sections of the head in the one preferred embodiment of the invention disclosed here within. Placement of the orifices along the bottom tubular section 12*a* on each side of the centerline of the tubing in FIG. 4 is symmetrical but the labelling entered in the left and right portions of FIG. 4 relate to different aspects of the orifice locations. The labelling indicated on the right portion of FIG. 4 relates to the degree of angular offset establishing the location of the orifices in the three indicated sectors each side of the center of the bottom section 12*a* with respect to a normal extending from the centerline of the tube wall forming the front face of the annular head 10 to the central axis of the tubing interior, the offset being in the direction of the central portion of the annular head 10. FIGS. 5 and 5A illustrate the 18 offset location of the orifices 18 in those portions of the annular head comprising both the outermost two sectors of the bottom section 12*a* of the head next adjacent the side sections 11, 11*a* and the orifices 18 in all portions of the side sections 11, 11*a* and the top section 12 of the annular head. FIGS. 6 and 6A illustrate the 30 offset location of the orifices 18*a* in the central, lowermost sector of the bottom tubular section 12*a*. Similarly FIGS. 7 and 7A illustrate the 24 offset location of the orifices 18*b* in the sectors between those of the central, lowermost sector of FIGS. 6, 6A and the outermost sectors of FIGS. 5, 5A. The varying offset locations of the orifices 18 of FIG. 5A, orifices 18*b* of FIG. 7A, and orfices 18*a* of FIG. 6A with respect to normals extending from the centerline of the tube wall constituting the outer face of the annular head 10 to the central axis of the tube interior define arcs that subtend acutes angles of 18, 24 and 30, respectively, and creates the inwardly directed annular spray pattern illustrated in FIG. 8 in which the lower portion of the spray pattern has varying degrees of upwardly and inwardly directed components of spray with the lower, centermost portion having the greatest vertical and inwardly directed component which decreases in the outermost and top portions of the annular spray pattern.

The region labelling shown on the left portion of FIG. 4 relates to the spacing between adjacent orifices in the lower portion of the bottom tubular section 12*a* of the shower head and the remainder of the tubing in the side sections 11, 11*a* and the top section 12 of the head, which is another significant feature of the invention. As noted in FIG. 4 the spacing between adjacent orfices progressively increases from the centerline of the bottom tube section 12*a* outwardly toward the ends of the bottom tube section 12*a* adjoining the side tube sections 11, 11*a*. In the illustrated embodiment of FIG. 4, the circumferential spacing between adjacent orifices at the center of the bottom tube section 12*a* subtends an angle of 4 with respect to the center of the arc formed by the bottom tubular section 12*a* and the spacing between each of the next ten orifices beyond the lower centerline of the bottom tube section 12*a* increases the subtended angle by 0.5, thereby establishing a progressively increase interval between adjacent orifices extending from the lower center of the bottom tubular section 12*a* outwardly over a major portion of the bottom section 12*a*. This results in establishing a more voluminous spray pattern in the central portion of the bottom tubular section 12*a* of the shower head which pattern progressively decreases in intensity toward the outer ends of the bottom tubular section 12*a*.

Figure 8:
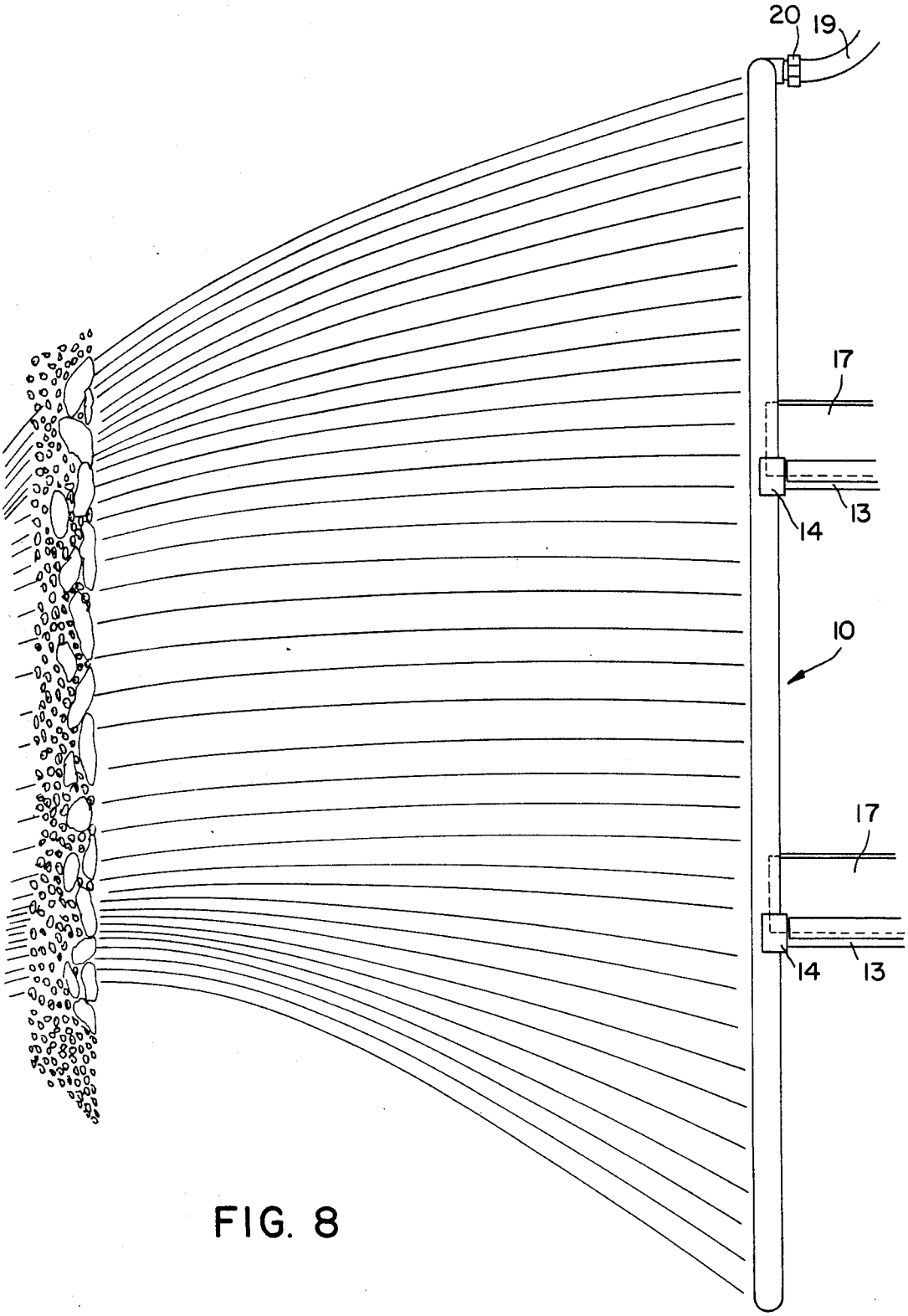
FIG. 8 is a side elevation of the shower head corresponding to FIG. 2 illustrating the spray pattern produced by water discharged from the spray orifices of the head.

The total result achieved by combining the described significant features of the invention of locating the orifices in the three indicated regions of the bottom tubular section 12*a* of the head at different offset distances from the centerline of the tube outer wall as will subtend larger acute angles with respect to the tube interior axis along the central portion of the bottom section 12*a* of the head and incrementally increasing these offset distances toward the outer sectors of the bottom tubular section 12*a* and the other tubular sections 11, 11*a* and 12 of the shower head as will subtend lesser acute angles with respect to the tube interior axis combined with the additional feature of progressively increasing the spacing between adjacent orifices outwardly from the center of the bottom tubular section 12*a* of the head is visually demonstrated by FIG. 8. As is readily apparent from that Figure the portion of the converging annular spray pattern emanating from the central portion of the bottom section 12*a* of the head is directed upwardly and inwardly at a greater angle and in greater volume and intensity than in the outer portions of the spray pattern nearer and along the side sections 11, 11*a* and the top section 12 of the shower head, thereby establishing a higher degree of cleansing action in the area of the lower trunk portion of the bather's body.

Figure 9:
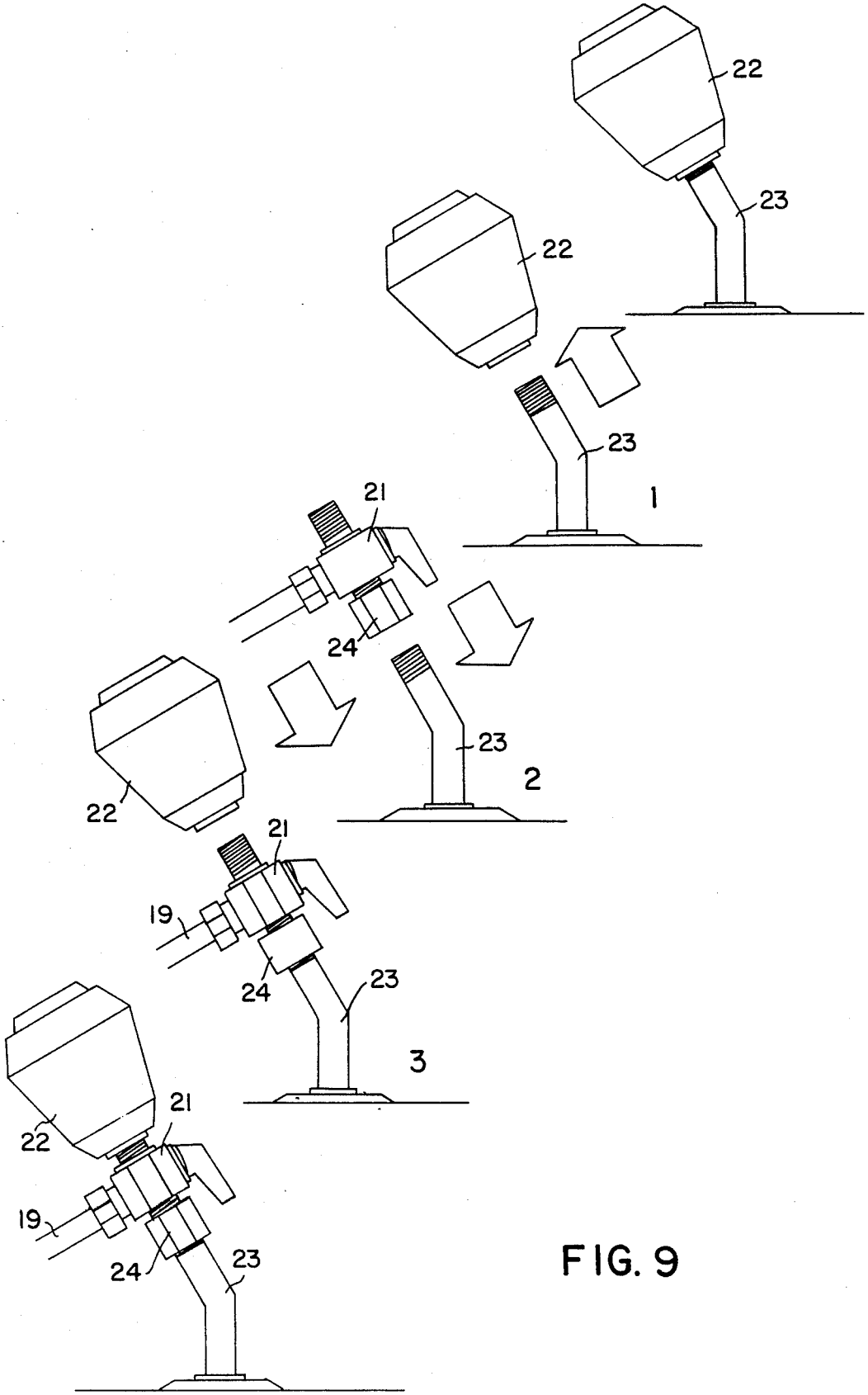
FIG. 9 is an illustration of a standard overhead shower head installation and connections thereto to the shower head of FIG. 2.

The installation of an annular shower head in a stall shower containing a standard overhead shower head is illustrated in FIG. 9 in conjunction with reference to FIGS. 2 and 3. The top portion of FIG. 9 illustrates a standard overhead shower head arrangement in which a head 22 is threaded onto the end of a water supply line 23 extending into the stall shower area from the shower wall 16 as indicated in FIG. 2. A 3 way valve T connection 21 is threaded onto the end of the water supply line 23 after the overhead shower head 22 is unscrewed from the water supply line 23, in the manner illustrated in part 1 of FIG. 9, by engaging the female connector 24 of the three way valve T connector 21 with the threads of the water supply line 23 as illustrated in parts 2 and 3 of FIG. 9. One end of a flexible supply line 19 is connected into the top tubular section 12 of the annular shower head by means by a threaded connector 20 and the other end of the flexible line 19 has a threaded connection that fits into the three-way valve T connector 21 in the manner illustrated in parts 2 and 3 of FIG. 9. If desired the overhead shower head 22 can be threaded onto the male connector of the three-way valve T connector 21 in the manner shown in the lower illustration of FIG. 9. By selecting one of the three positions of the valve T connector 21 the bather may choose to be bathed from the spray of the annular shower head 10, the overhead shower head 21 or a combination of both.

The described angular positions and spacing of the orifices in the disclosed embodiment of the invention are not necessarily critical in practicing the invention but are those which have established a highly effective and efficient spray pattern from an annular shower head formed of hollow tubing of 1/4 inch inside diameter in which 1/16 inch orifices are spaced along the length of the annular head in the described manner with the dimensions of the annular head being 32 inches in height and 12 inches in width and the top and bottom sections of the head being semi-circular.

Whereas the one preferred embodiment described herein is annular in shape with a top section 12 into which a water supply line 19 can be most conveniently connected, as illustrated in FIG. 3, the top section 12 could be omitted or altered in shape so as to provide an elongated shower head in the shape of an elongated and vertically disposed loop having a pair of spaced apart, vertically disposed side sections of which the lower ends are joined by a horizontally extending bottom portion. A number of variations in spacing and locations of the orifices along the length of the tubing and the shape of the elongated loop of the shower head from that described herein can be made in practicing the invention as described in the claims. Accordingly, it should be understood that the foregoing disclosure involves a preferred, typical embodiment of the invention and that numerous modifications or alterations may be made therein without departing from the spirit and scope of the invention as set forth in the appendant claims.

What I claim is:

1. An elongated shower head comprising a length of hollow tubing in the shape of an elongated loop having two spaced apart side sections and a bottom section joining respective lower ends of said side sections, said hollow tubing having an outer wall concentric of a central axis extending lengthwise of said loop, and means supporting said tubing length in a shower area with said side sections disposed vertically and said bottom section extending horizontally between said side section lower ends such that semi-circumferential portions of said tubing outer wall comprise one face of said loop facing outwardly of a shower area wall, said tubing outer wall portions of said side and bottom sections of said loop one face containing orifices spaced apart lengthwise of said sections and offset a distance circumferentially of the tubing from the centerline of said tubing outer wall semi-circumferential portions comprising said loop one face in the direction of the central region of said loop, said offset distances of said orifices in a central sector portion of said bottom section tubing being greater than the offset distances of orifices in sectors of outer portions of said bottom section tubing adjacent each said side section.

2. The shower head of claim 1 wherein said bottom section tubing includes a plurality of sectors between said bottom section central portion sector and each said loop side sections and said offset distances of said orifices in the tubing of each adjacent sector between said central sector and each said loop side section are progressively less.

3. The shower head of claim 1 wherein said elongated loop of hollow tubing is annular in shape to include a top section joining respective upper ends of said side sections forming a closed loop.

4. The shower head of claim 3 wherein said tubing outer wall portion of said top section of said loop one face contains orifices spaced apart lengthwise of said top section and offset a distance circumferentially of the tubing from the centerline of said top section tubing outer wall portion comprising said loop one face in the direction of the central region of said loop.

5. The shower head of claim 4 wherein said bottom section tubing includes a plurality of sectors between said bottom section central portion sector and each said loop side sections and said offset distances of said orifices in the tubing of each adjacent sector between said central sector and each said loop side section are progressively less.

6. An elongated shower head comprising a length of hollow tubing in the shape of an elongated loop having two spaced apart side sections and a bottom section joining respective lower ends of said side sections, said hollow tubing having an outer wall concentric of a central axis extending lengthwise of said loop, and means supporting said tubing length in a shower area with said side sections disposed vertically and said bottom section extending horizontally between said side section lower ends such that semi-circumferential portions of said tubing outer wall comprise one face of said loop facing outwardly of a shower area wall, said tubing outer wall portions of said side and bottom sections of said loop one face containing orifices spaced apart lengthwise of said sections and offset a distance circumferentially of the tubing from the centerline of said tubing outer wall semi-circumferential portions comprising said loop one face in the direction of the central region of said loop, the interval between adjacent orifices in the tubing of a central portion of said loop bottom section being less than that of adjacent orifices in the tubing of outer portions of said loop bottom section adjacent each said loop side section.

7. The shower head of claim 6 wherein said elongated loop of hollow tubing is annular in shape and includes a top section joining respective upper ends of said side sections forming a closed loop.

8. The shower head of claim 7 wherein said tubing outer wall portion of said top section of said loop one face contains orifices spaced apart lengthwise of said top section and offset a distance circumferentially of the tubing from the centerline of said top section tubing outer wall portion comprising said loop one face in the direction of the central region of said loop.

9. The shower head of claim 8 wherein said offset distances said orifices in a central sector portion of said bottom section tubing are greater than the offset distances of orifices in the outer sector portions of said bottom section adjacent each said side section.

10. The shower head of claim 9 wherein said bottom section tubing includes a plurality of sectors between said bottom section central portion sector and each said loop side sections and said offset distances of said orifices in the tubing of each adjacent sector between said central sector and each said loop side section are progressively less.

11. The shower head of claim 12 wherein the interval between adjacent orifices in the tubing of adjacent sectors of said bottom section progressively increase in each said bottom section sector between the center of said bottom section and outer portions of said bottom section adjacent said side sections.

12. The shower head of claim 6 wherein said offset distances of said orifices in a central sector portion of said bottom section tubing are greater than the offset distances of orifices in the outer sector portions of said bottom section adjacent each said side section.

13. The shower head of claim 12 wherein said bottom section tubing includes a plurality of sectors between said bottom section central portion sector and each said loop side sections and said offset distances of said orifices in the tubing of each adjacent sector between said central sector and each said loop side section are progressively less.

14. The shower head of claim 13 wherein in the interval between adjacent orifices in the tubing of adjacent sectors of said bottom section progressively increase in each said bottom section sector between the center of said bottom section and each said side section.

15. In an elongated shower head comprising a loop of hollow tubing of which its central passage is defined by an outer wall of said tubing containing orifices spaced apart lengthwise of said loop, semi-circumferential portions of said tubing outer wall defining opposite faces of said loop, and means supporting said loop disposing one of said loop faces transversely of and facing outwardly of a shower area wall with a pair of spaced apart side sections of said loop extending vertically and a bottom section of said loop extending horizontally between lower ends of each said side section, the improvement wherein said orifices are located on tubing outer wall portions at points spaced circumferentially of said tubing from the centerline of said tubing outer wall comprising said loop one face in the direction of the interior region of said loop as defines arcs subtended by acute angles with those orifices in the tubing wall of a central portion of said bottom section located to define arcs subtended by larger acute angles than the arcs defined by orifices contained in portions of said bottom section tubing adjacent said side sections.

16. In the elongated shower head of claim 15, the improvement wherein said bottom section tubing includes a plurality of sectors in which the orifices contained in the tubing of each adjacent sector each side of the center of said bottom section are located to define arcs subtended by progressively decreasing acute angles.

17. In the elongated shower head of claim 15, the improvement wherein the interval between adjacent orifices in a central portion of said bottom section tubing is less than intervals between adjacent orifices in outer portions of said bottom section tubing adjacent said loop side sections.

18. In the elongated shower head of claim 17, the improvement wherein said bottom section tubing includes a plurality of sectors in which the orifices contained in the tubing of each adjacent sector each side of the center of said bottom section are located to define arcs subtended by progressively decreasing acute angles.

19. In the elongated shower head of claim 18, the improvement wherein said bottom section tubing includes a plurality of sectors in which the orifices contained in the tubing wall of each respective adjacent tubing sector extending outwardly of the center of said bottom section are spaced apart at progressively increasing intervals.

20. In the elongated shower head of claim 17, the improvement wherein said bottom section tubing includes a plurality of sectors in which the orifices contained in the tubing wall of each respective adjacent tubing sector extending outwardly of the center of said bottom section are spaced apart at progressively increasing intervals.

21. In an elongated shower head comprising a loop of hollow tubing of which its central passage is defined by an outer wall of said tubing containing orifices spaced apart lengthwise of said loop, semi-circumferential portions of said tubing outer wall defining opposite faces of said loop, and means supporting said loop disposing one of said loop faces transversely of and facing outwardly of a shower area wall with a pair of spaced apart side sections of said loop extending vertically and a bottom section of said loop extending horizontally between lower ends of each said side section, the improvement wherein said orifices are located on tubing outer wall portions at points spaced circumferentially of said tubing from the centerline of said tubing outer wall comprising said loop one face in the direction of the interior region of said loop as defines arcs subtended by acute angles with the interval between adjacent orifices in a central portion of said bottom section tubing being less than intervals between adjacent orifices in outer portions of said bottom section tubing adjacent said loop side sections.

22. In the elongated shower head of claim 21, the improvement wherein said bottom section tubing includes a plurality of sectors in which the orifices contained in the tubing wall of each respective adjacent tubing sector extending outwardly of the center of said bottom section are spaced apart at progressively increasing intervals.

* * * * *